United States Patent [19]

Rossmann

[11] 4,327,154

[45] Apr. 27, 1982

[54] HIGH-STRENGTH COMPONENTS OF COMPLEX GEOMETRIC SHAPE AND METHOD FOR THEIR MANUFACTURE

[75] Inventor: Axel Rossmann, Karlsfeld, Fed. Rep. of Germany

[73] Assignee: Motoren- und Turbinen-Union Muenchen GmbH, Munich, Fed. Rep. of Germany

[21] Appl. No.: 931,381

[22] Filed: Aug. 7, 1978

[30] Foreign Application Priority Data

Aug. 18, 1977 [DE] Fed. Rep. of Germany ..... 2737248

[51] Int. Cl.[3] ..... B22F 3/00

[52] U.S. Cl. ..... 428/545; 75/213; 75/223; 75/226; 75/0.5 C

[58] Field of Search ..... 428/545, 546, 547, 548; 75/213, 223, 226, 0.5 C

[56] References Cited

U.S. PATENT DOCUMENTS

| | | | |
|---|---|---|---|
| 2,714,245 | 8/1955 | Goetzel | 428/545 |
| 3,340,053 | 9/1967 | Hodge et al. | 75/226 |
| 3,954,461 | 5/1976 | Chao et al. | 75/213 |

*Primary Examiner*—J. L. Barr

*Attorney, Agent, or Firm*—W. G. Fasse; D. F. Gould

[57] ABSTRACT

A high-strength component of complex geometric shape is formed by a core of hollow spheres of metallic particles surrounded by a shell of homogeneous metallic material. The hollow spheres are intimately bonded to each other and to the inner walls of the surrounding shell by hot isostatic pressing. The pressing procedure is enhanced by the use of elements such as boron which lower the melting point of the hollow spheres, for example, when said spheres are coated by said boron.

9 Claims, 4 Drawing Figures

HIGH-STRENGTH COMPONENTS OF COMPLEX GEOMETRIC SHAPE AND METHOD FOR THEIR MANUFACTURE

BACKGROUND OF THE INVENTION

This invention relates to high-strength structural components of complex geometric shape, for example, spherical shape.

Heretofore, such components have been made in the form of homogeneous metallic parts or in the form of pressed or sintered parts of ceramic materials. Homogeneous metal parts provide the advantage that they can be manufactured in complex geometric shapes by conventional metal working processes. However, such homogeneous metal parts have the disadvantage that their strength, especially at elevated temperatures, often no longer satisfies present day requirements. Pressed or sintered components of ceramic materials have high strength characteristics even at an elevated temperature range. However, complex geometric shapes may be achieved, if at all, only by unduly elaborate manufacturing efforts.

Finally, in light-weight construction, a certain class of so-called multiple-layer or composite components such as sandwich structures is manufactured of sheet-like semifinished materials. While said composite components exhibit relatively great strength, they can be produced only in relatively simple shapes such as plane parts in the form of panels or the like. Parts of complex shape used in mechanical engineering, such as gearbox casings, shafts, low pressure compressor blades and turbine blades cannot be realized due to the limited deep drawing capacity of such semifinished materials. Spherical shaping is virtually impossible. A further disadvantage of these composite components is that the joints between the various layers, as a rule there would be two walls enclosing a porous core, can transfer essentially only pressure loads but not shearing loads.

OBJECTS OF THE INVENTION

In view of the above it is the aim of the invention to achieve the following objects singly or in combination:

to achieve the forming of a component having a complex geometric shape, for example a spherical shape which also has high-strength especially over a wide range of temperatures;

to provide such a component with a core made of atomized metallic particles surrounded by and intimately bonded to a shell of homogeneous metallic materials;

to provide a method for manufacturing such high-strength components;

to provide a method for manufacturing the atomized metallic particles as hollow spheres;

to make such a component of complex shape yet capable of taking up all kinds of loads;

to produce the complex shape component so as to be machinable after an isostatic pressure formation step; and to produce such complex shape components at reasonable costs.

SUMMARY OF THE INVENTION

According to the invention there is provided a complex shape structural component having a core pressed of metal powder, especially of hollow spherical metal powder particles, surrounded by a core of homogeneous metallic material.

A component constructed according to the invention provides a very good bonding between the pressed core and the shell permitting all types of loads to be taken up. Such components combine great strength derived from the pressed core with a possibility of making complex geometrical shapes since the shell of a homogeneous metallic material may be formed by or shaped by any one of the conventional machining processes before or after it is united with the core. An especially intimate bond between the core and the shell is achieved when the core and the shell are made of similar materials which are compatible with each other.

The present invention further relates to a method for manufacturing a component as described above, by the following process steps:

(a) manufacturing a hollow shell of a homogenous metal and having a geometric shape which corresponds substantially to the final geometric shape of the component;

(b) filling the hollow shell with metal powder, especially hollow spherical metal particles;

(c) evacuating the hollow shell and sealing it in a gas tight manner; and (d) subjecting the filled shell to heat and pressure under isostatic conditions thereby adjusting the pressure and temperature so that the hollow spheres will deform until the spaces or interstices between the spheres and the spaces between the spheres and the inner wall of the shell have disappeared.

The strength of a component manufactured in accordance with the present method is especially high due to the diffusion welding which takes place during the hot isostatic pressing of the spherical powder particles one against the other as well as between the particles and the inner wall of the shell. A further advantage provided by the method of the present invention is seen in that it permits wide variations of the geometric shape of the component, so that the shell may comprise cross-sectional zones of solid material where required, as would be an essential requirement, for example, at the roots of turbine blades. A further advantage afforded by this method is seen in that it permits an optimization of specific component requirements, such as the strength at certain temperatures, by selective use of the dissimilar metals for making the outer shell and the core.

An especially intimate bond between the core and the outer shell is achieved preferably by using similar materials for both the hollow-sphere powder and the shell. Another preferred aspect of the present invention is achieved when the hollow spheres of powder are combined with a melting point lowering agent, for example, by coating the powder particles with boron whereby sintering may take place when the metal is in a liquid or in a the pasty phase, whereby the pressures used in the hot isostatic pressing can be held at a relatively low level.

BRIEF FIGURE DESCRIPTION

In order that the invention may be clearly understood it will now be described by way of example, with reference to the accompanying drawings, wherein.

DETAILED DESCRIPTION OF PREFERRED EXAMPLE EMBODIMENTS

Figure 1:
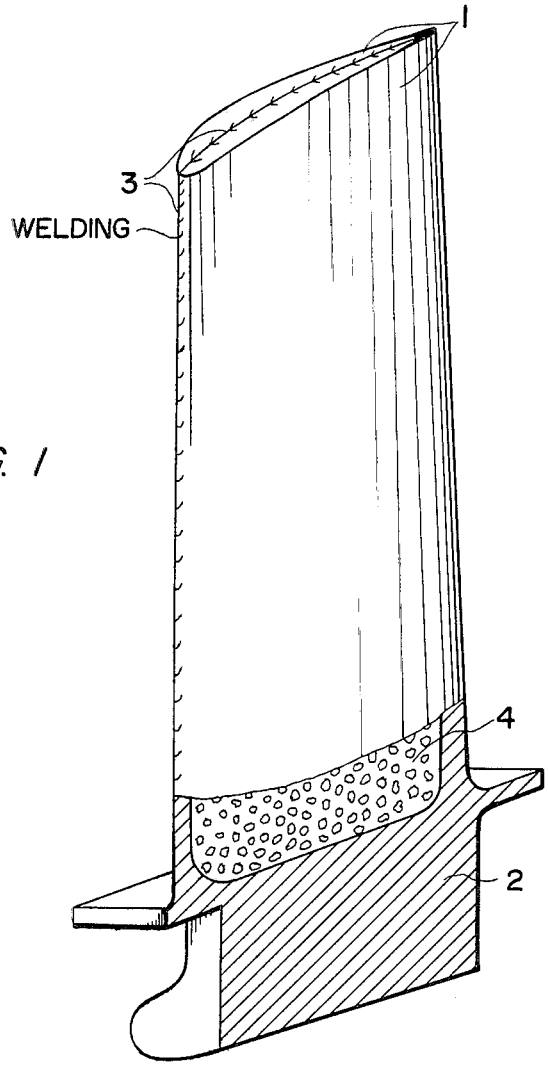
FIG. 1 is a perspective view of a turbine rotor blade, with a portion cut away for clarity.

The turbine blade illustrated in FIG. 1 comprises a shell formed of two half-shells 1 welded together along the mating surfaces 3. The walls of the half-shells 1 are very thin at the wing area of the blade, but are solid metal at the blade root 2. In this example the wall thickness of the shell could be within the range of 0.5 mm to some millimeters (depending on the height and the shape of the blade). The porous core 4 is made of hollow spherical metal powder particles. The half-shells 1 may be manufactured using conventional metal processing techniques such as casting, forging, pressing, deep drawing, injection molding and so forth.

Figure 2:
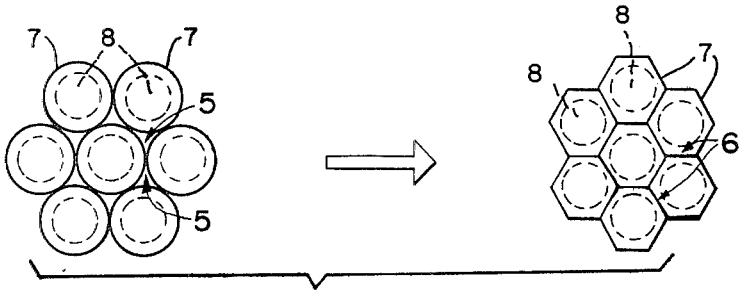
FIG. 2 illustrates the change taking place in the core structure of the blade due to the hot isostatic pressing.

FIG. 2 illustrates the difference in structure of the particles making up the core 4 before and after the hot isostatic pressing. The left-hand portion of FIG. 2 illustrates the arrangement of the spherical powder particles 7 with their hollow spaces 8 before the hot isostatic pressing step when the spaces 5 or interstices between the spherical powder particles are still present. The right-hand portion of FIG. 2 illustrates the spatial structure of the powder particles 7 after the hot isostatic pressing step, whereby the seams 6 along the mating surfaces of the powder particles are welded together by diffusion for an intimate bond between the particles 7 while maintaining the hollow spaces 8 separated from one another as shown in the right hand portion of FIG. 2.

Metal powders suitable for the present purposes of making the core may, for example, be selected from the group comprising titanium or socalled superalloys. The metals suitable for making the shell may be selected, from the same group.

The hot isostatic pressing may be performed at temperatures ranging from about 1000° C. to about 1400° C. depending on the type of metal powder used. The pressures will depend on the size and shape of the component to be made and may range from 10 bar to $10^3$ bar. Such pressures may be applied in suitable containers which may be pressurized by hydraulic or pneumatic means of conventional construction.

Figure 3:
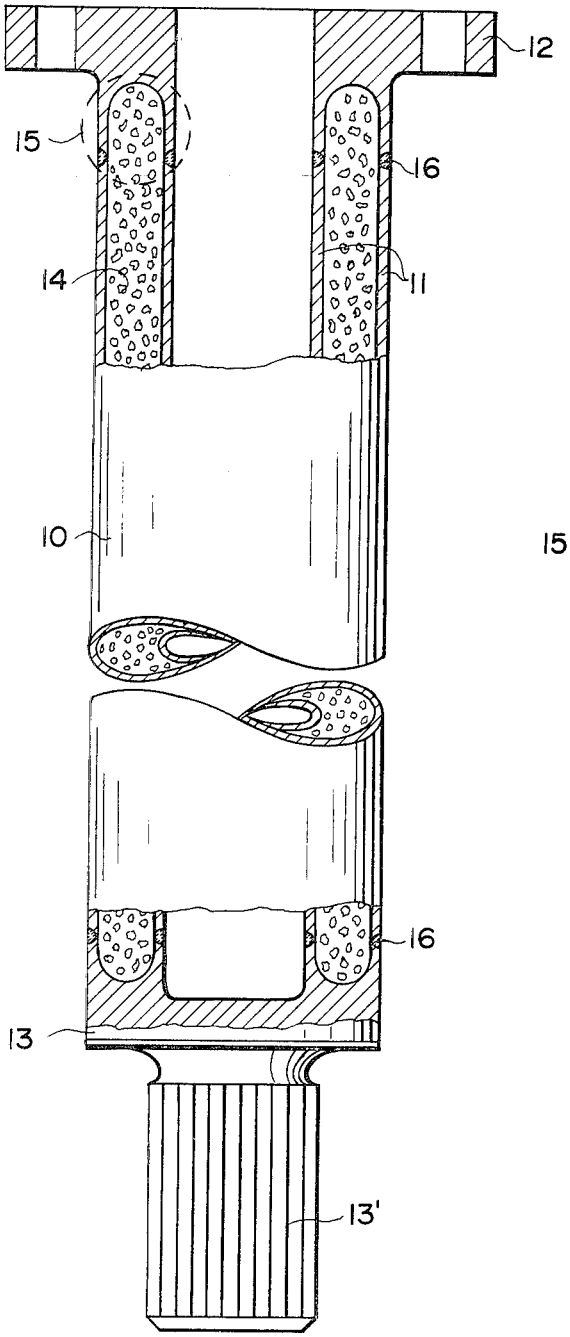
FIG. 3 is a partially sectional view of a hollow shaft and illustrates a tubular shaft provided with a flange and a splined connecting end.

The hollow shaft illustrated in FIG. 3 essentially comprises a multi-layered cylindrical section 10, a solid-metal flange 12, and solid material connecting splines 13. The composite cylindrical portion 10 comprises a double inner and outer pipe 11 with a core 14 of hollow, spherical metal powder particles arranged in the annular space between the pipes. The geometric shape of the tubular shaft illustrated on the drawing reflects its condition after the completion of the hot isostatic pressing or already after final mechanical machining.

Figure 3A:
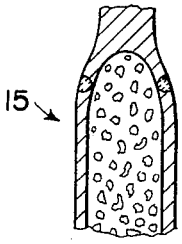
FIG. 3*a* is an enlarge portion shown by a dash-dotted circle in FIG. 3.

The connecting area 15 between the flange 12 and the composite cylindrical portion 10 is shown in enlarged detail view in FIG. 3*a* in a condition prior to the isostatic pressing to illustrate that the cross section of the core 14 must be larger, before the hot isostatic pressing, than the cross-section of the solid metal flange portion of the flange 12 so that a proper matching is assured after the pressing. This holds true also for the area where the splines 13 are connected to the cylindrical pipe portion 10. The end sections 12 and 13 may be joined to the pipe portion 10, for example, by welding seams 16.

In the manufacture of the metallic shell or of the hollow body formed by the shell the oversize needed to provide the intended final size after the hot isostatic pressing must be taken into account. The oversize will depend on the type of component but it has been found to be sufficient in most instances to provide a linear oversize in the range of 5% to 20% of the respective dimension (length) after the hot isostatic pressing.

Although the invention has been described with reference to specific example embodiments, it is to be understood, that it is intended to cover all modifications and equivalents within the scope of the appended claims.

Incidentally, the present invention also provides a method for manufacturing a metal powder of hollow, spherical particles by atomizing a metal melt in an atmosphere of an inert gas, particularly argon.

What is claimed is:

1. A high strength component comprising a shell of the desired final shape and a core having a given shape fitting into said shell, said core being made of atomized metallic particles which are initially of substantially spherical shape having hollow spaces therein, said particles being pressed into said given shape to form said core directly in said shell whereby said metallic particles are bonded at their outer surfaces to one another and to said shell, while said hollow spaces remain separated from one another, said shell of homogeneous metallic material permanently surrounding said core, whereby strength as well as complex geometric shapes may be attained.

2. The component of claim 1, wherein said core and said shell are made of metal selected from the group consisting of titanium and super alloys.

3. A method of manufacturing a high strength component having a core and a shell intimately and permanently bonded to said core, comprising the following steps:

(a) manufacturing a homogeneous metallic shell substantially with a shape corresponding to the final shape of the component;

(b) filling said shell with atomized metallic particles which are initially of substantially spherical shape having hollow spaces therein;

(c) evacuating said shell and hermetically sealing said atomized metallic particles in said shell; and (d) subjecting said evacuated and sealed shell to hot isostatic pressing by adjusting the temperature and pressure so that the atomized metallic particles of the core deform until all the interstices between said particles themselves and between the particles and the inner wall of the shell have substantially disappeared and the particles become intimately bonded to one another and to the inside of the shell, whereby said core becomes intimately bonded to said shell and whereby said hollow spaces remain separated from one another in the high strength component.

4. The method of claim 3, wherein said shell and said core are made of metal selected from the group consisting of titanium and super alloys.

5. The method of claim 3 or 4 further comprising providing said atomized metallic particles with melting point lowering means.

6. The method of claim 5, comprising coating said atomized metallic particles with boron acting as a melting point lowering agent.

7. The method of claim 3, further mechanically or electromechanically finishing said component after completing said isostatic pressing.

8. A method for manufacturing atomized metallic particles having hollow spherical shapes, comprising atomizing a metal melt in an inert gaseous atmosphere.

9. The method of claim 8, wherein said inert gaseous atmosphere includes argon.

* * * * *